United States Patent [19]

De Concini et al.

[11] Patent Number: 4,778,112

[45] Date of Patent: Oct. 18, 1988

[54] ELECTROMAGNETIC FUEL METERING AND ATOMIZING VALVE FOR A SUPPLY DEVICE ON AN INTERNAL COMBUSTION ENGINE

[75] Inventors: Roberto De Concini, Zola Predosa; Marcello Cristiani, Imola, both of Italy

[73] Assignee: Weber S.r.l., Turin, Italy

[21] Appl. No.: 15,973

[22] Filed: Feb. 18, 1987

[30] Foreign Application Priority Data

Feb. 19, 1986 [IT] Italy ..... 67123 A/86

[51] Int. Cl.[4] ..... B05B 1/30

[52] U.S. Cl. ..... 239/585; 251/129.15; 251/129.16

[58] Field of Search ..... 239/585; 251/129.15, 251/129.16

[56] References Cited

U.S. PATENT DOCUMENTS

| | | | |
|---|---|---|---|
| 3,422,850 | 1/1969 | Caldwell | 251/129.16 |
| 3,702,683 | 11/1972 | Sturmer | 239/585 |
| 4,360,164 | 11/1982 | Bellicardi et al. | 239/585 |
| 4,403,741 | 9/1983 | Moriya et al. | 239/585 |
| 4,475,690 | 10/1984 | Hascher-Reichl et al. | 239/585 |
| 4,522,372 | 6/1985 | Yano et al. | 251/129.15 |

*Primary Examiner*—Andres Kashnikow
*Assistant Examiner*—Karen B. Merritt
*Attorney, Agent, or Firm*—Michael N. Meller

[57] ABSTRACT

A valve having a body inside which slides a plugging member integral with a keeper forming part of a magnetic circuit, which circuit comprises the walls of the aforementioned body, and a core located inside the same. The body presents a bottom wall having a hole through which slides the aforementioned plugging member, and the keeper presents an annular projection located on one side in relation to the aforementioned wall and having an outside diameter greater than that of the aforementioned hole, so as to provide for substantially axial magnetic flow lines between the aforementioned bottom wall and the keeper.

9 Claims, 2 Drawing Sheets

ELECTROMAGNETIC FUEL METERING AND ATOMIZING VALVE FOR A SUPPLY DEVICE ON AN INTERNAL COMBUSTION ENGINE

BACKGROUND OF THE INVENTION

The present invention relates to an electromagnetic fuel metering and atomizing valve for a supply device on an internal combustion engine, for the purpose of supplying the said device with given quantities of finely atomized fuel for the formation of an air and fuel mixture.

Valves of the aforementioned type usually comprise a substantially cylindrical body housing an annular electromagnet coaxial with the same; a nozzle having a fuel supply hole and fitted on to the front end of and coaxial with the said body; and a plugging member sliding axially inside the said body and the said nozzle. The plugging member presents an active surface designed to cooperate with a seat formed on the nozzle, for closing the said supply hole, and guide surfaces on the nozzle, for guiding the plugging member during axial displacement of the same. The valve body presents a coaxial core designed to exert electromagnetic force on a keeper integral with the plugging member, for the purpose of controlling displacement of the same. Such force is generated subsequent to activation of the electromagnet inside the body, which presents a cylindrical side wall, a top wall connected to the core, and a bottom wall in which is formed a hole through which the plugging member slides, so as to form, for the magnetic flow generated by the said magnet, a substantially closed magnetic circuit comprising the said walls, the said core and the said keeper.

Valves of the type outlined briefly above present a number of drawbacks, which tend to be aggravated during operation, to the extend that the valve becomes totally unusable.

Firstly, sealing between the said active surface on the plugging member and the mating seat formed on the nozzle may be faulty, due to poor mating of the said surface and seat caused by the plugging member and nozzle not being perfectly coaxial. Secondly, atomizing of the fuel (which is performed mainly by the outer surface of a pin projecting from the bottom end of the plugging member, and by the surface of the said supply hole) is not entirely regular, due to imperfect roundness of the annular supply opening defined between the pin and the hole. This drawback, too, is a result of imperfect concentricity of the plugging member and nozzle. Finally, metering action (which is also performed by the said pin and hole surfaces) may differ from one injection cycle to another, and fail to conform strictly with required performance. All the above drawbacks are the result of imperfect concentricity of the plugging member and nozzle, which occurs both with the valve closed and, more especially, during displacement of the plugging member in relation to the nozzle. Perfect concentricity of the plugging member and nozzle under all valve operating conditions has been found to be unachievable, even using highly accurate, efficient guide means for guiding the plugging member in relation to the nozzle. Such guide means usually consist of two sets of guide surfaces spaced along the plugging member and designed to mate, with very little radial slack, with the inner surface of the nozzle. Even if the said slack is barely sufficient for enabling smooth axial slide of the plugging member in relation to the nozzle, concentricity between the said two components still remains less than perfect, due to the components, of the electromagnetic force generated by the electromagnet, perpendicular to the axis of the plugging member. Owing to inevitable machining and assembly errors, the resultant of the electromagnetic forces which acts on the plugging member, instead of being strictly axial, presents transverse components, which tend to throw the plugging member off-center, and give rise to reactions in the guide areas between the plugging member and the nozzle. The said reactions, in turn, result in severe wear on the guide surfaces of the plugging member, thus resulting in even greater off-centering and, therefore, an increase in the off-balancing components of the electromagnetic force. Off-centering of the plugging member and nozzle therefore tends to increase rapidly and considerably, due to the off-balancing transverse components responsible for the said wear also increasing considerably alongside increasing wear.

SUMMARY OF THE INVENTION

The aim of the present invention is to provide an electromagnetic fuel metering and atomizing valve for a supply device on an internal combustion engine of the aforementioned type, but involving none of the aforementioned drawbacks, i.e. a valve providing for efficient atomizing and metering of the fuel, efficient sealing between the active surfaces of the plugging member and the respective seat, and which ensures such performance remains substantially unchanged throughout the life cycle of the valve.

With this aim in view, according to the present invention, there is provided an electromagnetic fuel metering and atomizing valve for a supply device on an internal combustion engine, said valve comprising a substantially cylindrical body housing an annular electromagnet coaxial with the same; a nozzle having a fuel supply hole and fitted on to the front end of and coaxial with the said body; and a plugging member designed to slide axially inside the said body and the said nozzle, and having an active surface cooperating with a seat formed on the said nozzle for closing the said supply hole, and guide surfaces cooperating with an inner surface of the said nozzle for guiding the said plugging member during axial displacement of the same; the said body presenting a coaxial core designed to exert electromagnetic force on a keeper integral with the said plugging member for controlling displacement of the same; and the said body presenting a cylindrical side wall, a top wall connected to the said core, and a bottom wall in which there is formed a hole through which the said plugging member slides, so as to form, for the magnetic flow generated by the said magnet, a substantially closed magnetic circuit comprising the said walls, the said core and the said keeper; characterised by the fact that the said keeper presents at least an annular projection located on one side in relation to the said bottom wall of the said body and having an outside diameter greater than that of the said hole formed in the said bottom wall, so as to provide for substantially axial magnetic flow lines between the said bottom wall and the said keeper.

BRIEF DESCRIPTION OF THE DRAWINGS

Two embodiments of the present invention will be described, by way of non-limiting examples, with reference to the accompanying drawings, in which.

DETAILED DESCRIPTION OF THE INVENTION

Figure 1:
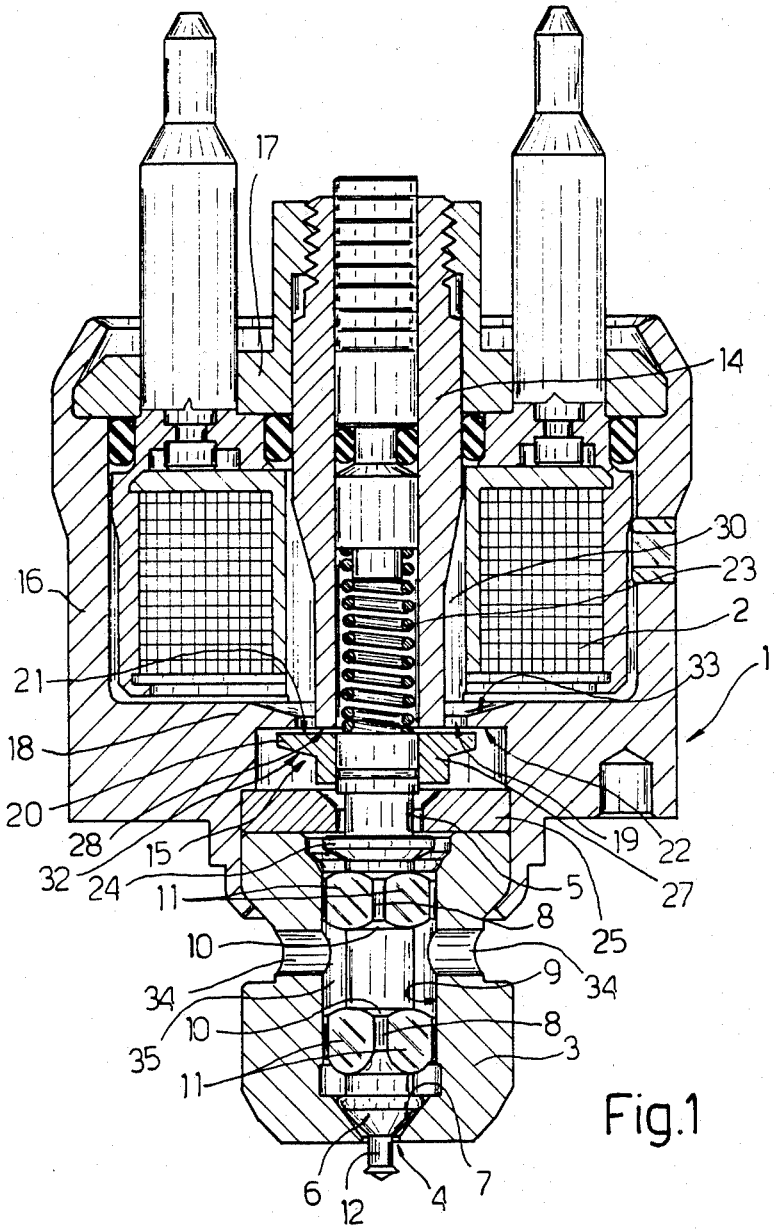
FIG. 1 shows an axial section of a first embodiment of the valve according to the teachings of the present invention.

The valve according to the present invention is designed to be fitted on to a supply device of an internal combustion engine, for supplying an air and petrol mixture to the manifold on the engine or directly into the cylinders of the same.

The said valve comprises a substantially cylindrical body 1 housing a coaxial annular electromagnet 2; a nozzle 3 having a fuel supply hole 4 and fitted on to the front end of and coaxial with the said body 1; and a plugging member 5 designed to slide axially inside the said body 1 and the said nozzle 3. The said member 5 presents an active surface 6, cooperating with a seat 7 formed on the said nozzle 3 for closing the said hole 4, and a pin 12. Plugging member 5 presents guide means conveniently comprising two sets of guide surfaces 8 cooperating with an inner surface 9 on nozzle 3, for guiding plugging member 5 during axial displacement of the same. Each set of the said guide surfaces consists of portions of the cylindrical surface externally defining an annular projection 10, which portions are obtained by flattening portions 11 of the said projection 10.

Body 1 presents a coaxial core 14 designed to exert electromagnetic force on a keeper 15 integral with plugging member 5 for controlling displacement of the same. Body 1 conveniently presents a cylindrical side wall 16, a top wall 17 connected to core 14 and side wall 16, and a bottom wall 18 in which is formed a hole 19 through which slides plugging member 5, so as to form, for the magnetic flow generated by electromagnet 2, a substantially closed magnetic circuit comprising walls 16, 17 and 18, core 14, and keeper 15.

Keeper 15 presents at least an annular projection 20 located on one side in relation to bottom wall 18 and having an outside diameter greater than that of hole 19, as shown clearly in the accompanying drawings. Annular projection 20 presents a first flat surface 21 facing bottom wall 18 and perpendicular to the axis of plugging member 5. The said wall 18, in turn, presents a second flat surface 22 facing annular projection 20 and also perpendicular to the axis of plugging member 5. The axial clearance between flat surfaces 21 and 22 is just slightly greater than the travelling distance of plugging member 5 required for switching from the closed valve to the open valve position. The valve is set to the closed position when active surface 6 on plugging member 5 contacts seat 7 by virtue of a helical spring 23 acting on the top end of member 5. The open valve position, on the other hand, is achieved when collar 24 on plugging member 5 contacts a mating stop washer 25 located between body 1 and nozzle 3.

Keeper 15 conveniently comprises a tubular portion 27 having a cylindrical inner surface housing plugging member 5, and from which projects radially annular projection 20. In the FIG. 1 embodiment, core 14, which is also substantially tubular in shape, is defined towards bottom wall 18 by a flat surface 28 perpendicular to the valve axis and lying substantially in the same plane as the second flat surface 22 of bottom wall 18. The inside and outside diameters of core 14 are conveniently substantially equal to those of tubular portion 27 of keeper 15. Furthermore, as shown clearly in FIG. 1, the outer surface of core 14 is tapered downwards.

Figure 2:
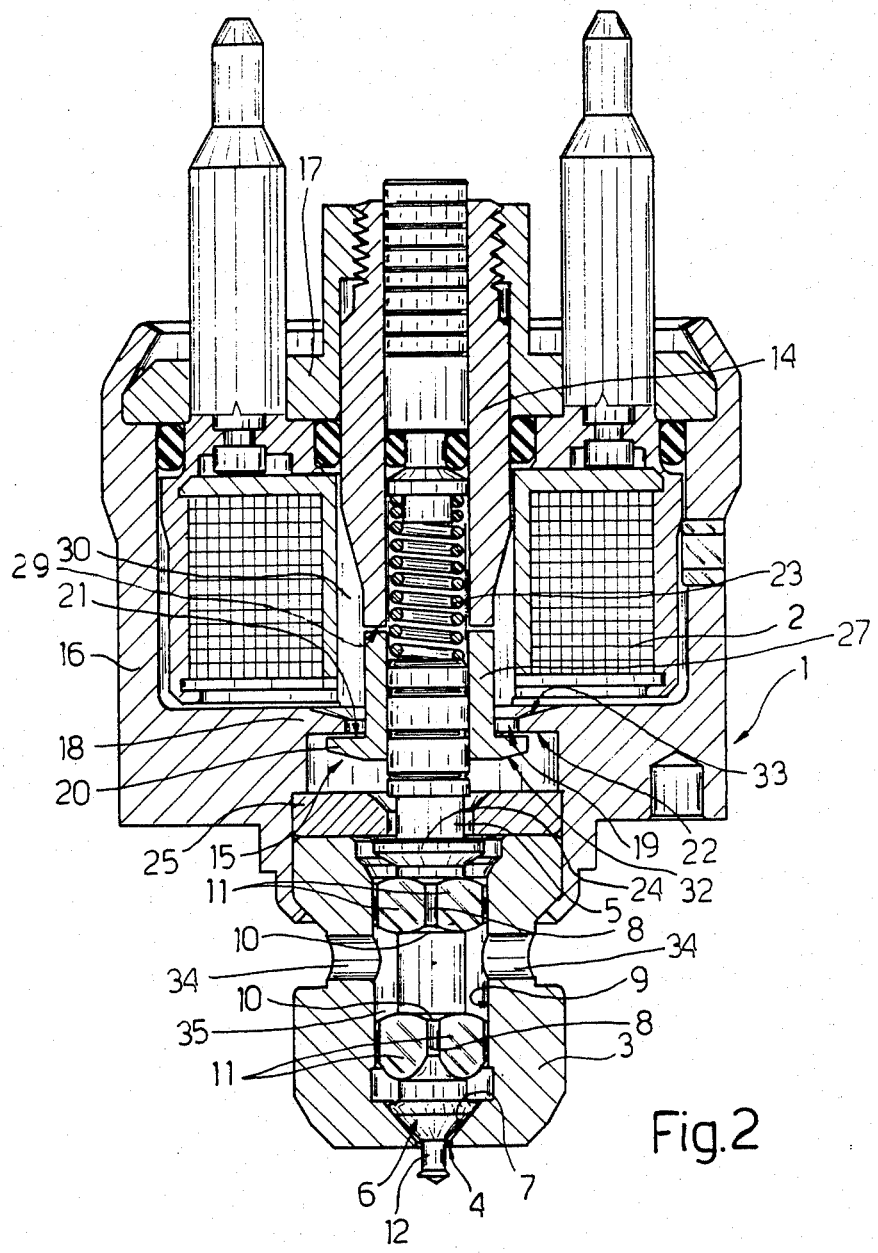
FIG. 2 shows an axial section of a second embodiment of the valve according to the teachings of the present invention.

In the FIG. 2 embodiment, core 14 is shorter, and flat surface 29 defining it at the bottom is located substantially inside compartment 30 housing electromagnet 2. In this case, tubular portion 27 of keeper 15, which is longer than in the FIG. 1 embodiment, is arranged facing core 14, and the inside and outside diameters of tubular porton 27 are substantially equal to those of the bottom portion of core 14. In this case also, the outer surface of core 14 is conveniently tapered downwards.

In the FIG. 2 embodiment, the distance between the points on the outer surface of tubular portion 27 of keeper 15 and the points on the surface of hole 19 in bottom wall 18 lying on the same radius is greater than the distance between the first and second flat surfaces 21 and 22 in the closed valve position shown in FIG. 2. Conveniently, the distance between the said points is over twice the distance between the said surfaces 21 and 22. Furthermore, the axial slack allowed between tubular portion 27 of keeper 15 and core 14 is substantially equal to the distance between flat surface 21 and keeper 15 and between flat surface 22 and bottom wall 18.

On the opposite side to that of first surface 21, annular projection 20 of keeper 15 is conveniently defined by a first conical surface 32; and bottom wall 18 of body 1 is defined, on the opposite side to that of second flat surface 22, by a second conical surface 33.

The valve according to the present invention operates as follows.

With the valve in the idle position, helical spring 23 holds active surface 6 of plugging member 5 against seat 7 on nozzle 3, so as to prevent fuel from being supplied through hole 4.

When electromagnet 2 is energised for injecting a given amount of atomized fuel, a magnetic flow is generated in the substantially closed magnetic circuit comprising core 14, keeper 15, and bottom wall 18, side wall 16 and top wall 17 of body 1. In particular, the magnetic flow between bottom wall 18 and keeper 15 travels in a substantially axial direction. In fact, by virtue of annular projection 20 (the outside diameter of which is considerably greater than the inside diameter of hole 19 in wall 18), a preferential, low-reluctance magnetic flow route is created between the outermost annular portion of the said annular projection and the annular portion of wall 18 surrounding hole 19. Consequently, as shown clearly in the accompanying drawings, the flow lines established between the said two portions are substantially axial and perpendicular to flat surfaces 21 and 22. Creation of the said flow lines in the said direction is also assisted by conical surface 33 on bottom wall 18 and conical surface 32 on annular projection 20.

The resultant of the electromagnetic forces exerted on keeper 15, which is therefore substantially axial, raises plugging member 5 against the action of spring 23, so as to open the fuel duct and allow fuel to flow through radial holes 34 on nozzle 3, annular chamber 35 defined between nozzle 3 and member 5, and the passages formed by flattened portions 11 on bottom projection 10 of member 5.

As, for the reasons already stated, the said resultant is substantially free from transverse components, no reactions are generated between guide surfaces 8 and the mating inner surface 9 of nozzle 3. Consequently, axial sliding of plugging member 5 involves substantially very little sliding friction, thus enabling the valve to be opened extremely rapidly. Furthermore, due to the absence of the said transverse components, plugging member 5 remains perfectly coaxial with valve body 1 and nozzle 3 during axial displacement. It follows, therefore, that active surface 6 and the surface externally defining pin 12 are maintained substantially coaxial at all times with seat 7 and the surface of hole 4, thus providing for efficient metering and atomizing of the fuel. Both these functions, in fact, are known to be greatly influenced by the symmetry of the annular compartments defined between the surfaces of plugging member 5 and those of nozzle 3 during displacement of the former in relation to the latter. As, for the reasons already stated, plugging member 5 is maintained at all times perfectly coaxial with nozzle 3, the size of the said compartments remains substantially unchanged in any meridian plane on the valve.

Furthermore, due to the total absence of any reaction between guide surfaces 8 on plugging member 5 and surface 9 on nozzle 3, substantially no wear is produced between the said mating surfaces, and the operating performance of the valve remains substantially unchanged over time. To those skilled in the art it will be clear that changes may be made to the form and arrangement of the component parts of the valve as described and illustrated herein without, however, departing from the scope of the present invention.

We claim:

1. In an electromagnetic fuel metering and atomizing valve for a supply device on an internal combustion engine, said valve comprising a substantially cylindrical body housing an annular electromagnet coaxial with said body; a nozzle having a fuel supply hole and fitted onto the front end of and coaxial with said body; and a plugging member designed to slide axially inside said body and said nozzle, and having an active surface cooperating with a seat formed on said nozzle for closing said supply hole, and guide surfaces cooperating with an inner surface of said nozzle for guiding said plugging member during axial displacement thereof; said body presenting a coaxial core designed to exert electromagnetic force on a keeper integral with said plugging member for controlling displacement thereof; and said body presenting a cylindrical side wall, a top wall connected to said core, and a bottom wall in which there is formed a hole through which said plugging member slides, so as to form, for the magnetic flux generated by said magnet, a substantially closed magnetic circuit comprising said walls, said core and said keeper; the improvement wherein said keeper presents at least an annular projection located on one side in relation to said bottom wall of said body and having an outside diameter greater than that of said hole formed in said bottom wall, so as to provide for substantially axial magnetic flux lines between said bottom wall and said keeper.

2. A valve as claimed in claim 1, wherein said annular projection on said keeper presents a first flat surface facing said bottom wall of said body and perpendicular to the axis of said plugging member; and said bottom wall of the said body presents a second flat surface facing said annular projection and also perpendicular to the axis of said plugging member the axial clearance between said first and said second flat surfaces being slightly greater than the travel distance required for said plugging member to switch from the closed valve position to the open valve position.

3. A valve as claimed in claim 1, wherein said keeper comprises a tubular portion, the inner surface of which houses said plugging member and from which said annular projection radially projects.

4. A valve as claimed in claim 1, wherein said core is substantially tubular in shape and defined, towards the bottom of the valve, by a flat surface perpendicular to the valve axis and lying substantially in the same plane as said second flat surface of said body.

5. A valve as claimed in claim 4, wherein the inside diameter of said core is substantially equal to that of said tubular portion of said keeper; and the outside diameter of said core is tapered downwards.

6. A valve as claimed in claim 1, wherein said core is substantially tubular in shape and defined, towards the bottom of the valve, by a flat surface perpendicular to the valve axis and located inside the compartment on said body housing said electromagnet; said tubular portion of said keeper facing said core, and the inside and outside diameters of said tubular portion being substantially equal to those of the bottom of said core; the outer surface of said core being tapered downwards.

7. A valve as claimed in claim 6, wherein the distance between the points on the outer surface of said tubular portion of said keeper and the points on the surface of said hole in said bottom wall lying on the same radius is greater than the distance between said first and said second flat surfaces when the valve is closed.

8. A valve as claimed in claim 7, wherein the distance between said points is over twice the distance between said surfaces.

9. A valve as claimed in claim 1, wherein on the side opposite that of said first flat surface, said annular projection on said keeper is defined by a first conical surface, and said bottom wall of said body is defined, on the side opposite that of said second flat surface, by a second conical surface.

* * * * *